US011795740B2

(12) United States Patent
Song

(10) Patent No.: US 11,795,740 B2
(45) Date of Patent: Oct. 24, 2023

(54) ENCLOSURE STRUCTURE AND ENCLOSURE ASSEMBLY COMPRISING THE SAME

(71) Applicant: All Star Houseware Ltd., Shanghai (CN)

(72) Inventor: Xiaowei Song, Shanghai (CN)

(73) Assignee: ALL STAR HOUSEWARE LTD., Shanghai (CN)

( * ) Notice: Subject to any disclaimer, the term of this patent is extended or adjusted under 35 U.S.C. 154(b) by 267 days.

(21) Appl. No.: 17/486,962

(22) Filed: Sep. 28, 2021

(65) Prior Publication Data

US 2022/0127884 A1 Apr. 28, 2022

(30) Foreign Application Priority Data

Oct. 23, 2020 (CN) ..... 202022382824.3
Apr. 1, 2021 (CN) ..... 202110356358.8

(51) Int. Cl.

| | |
|---|---|
| ***E05C 3/14*** | (2006.01) |
| ***E06B 3/86*** | (2006.01) |
| ***E05C 19/06*** | (2006.01) |
| ***E06B 3/70*** | (2006.01) |
| ***E05C 3/00*** | (2006.01) |
| *E05B 15/16* | (2006.01) |

(52) U.S. Cl.

CPC ..... *E05C 3/14* (2013.01); *E05C 3/008* (2013.01); *E05C 19/06* (2013.01); *E06B 3/70* (2013.01); *E06B 3/86* (2013.01); *E05B 15/1635* (2013.01); *E06B 2003/7049* (2013.01)

(58) Field of Classification Search

CPC . E05C 3/14; E05C 3/008; E05C 19/06; E06B 2003/7046; E06B 2003/7049; E06B 3/86; E06B 3/70; Y10S 292/38; Y10S 292/31; E05B 15/1635; E05B 2015/0468

See application file for complete search history.

(56) References Cited

U.S. PATENT DOCUMENTS 3,208,781 A * 9/1965 Appleberry ..... E05C 3/14 292/228
3,323,676 A * 6/1967 Poittevin ..... G03B 42/04 292/128
3,709,538 A * 1/1973 Seitz ..... E05C 3/14 292/DIG. 31

(Continued)

*Primary Examiner* — Justin B Rephann
(74) *Attorney, Agent, or Firm* — MATTHIAS SCHOLL P.C.; Matthias Scholl

(57) ABSTRACT

An enclosure structure including an enclosure body, a handle, and a slot. The enclosure body includes a first end portion and a second end portion that are disposed oppositely to each other. The enclosure body is provided with a clearance hole, and the clearance hole is disposed between the first end portion and the second end portion, and the handle is rotatably disposed on the enclosure body and is disposed between the clearance hole and the first end portion. The handle includes an elastic connecting portion, a boss, and a pressing portion. The pressing portion is configured to control a limiting member to be stuck in or detached from the slot. The elastic connecting portion protrudes out of the enclosure body and two ends thereof are connected to the enclosure body and the boss, respectively; the boss and the enclosure body are spaced apart.

20 Claims, 7 Drawing Sheets

(56) References Cited

U.S. PATENT DOCUMENTS

| | | | | | |
|---|---|---|---|---|---|
| 3,797,870 | A * | 3/1974 | Beckman | E05C 3/14 | 292/DIG. 31 |
| 4,492,396 | A * | 1/1985 | Luke | E05B 15/1635 | 292/DIG. 31 |
| 4,523,785 | A * | 6/1985 | Draper | B60J 7/1642 | 296/224 |
| 4,923,232 | A * | 5/1990 | Kawagoe | E05C 17/32 | 292/263 |
| 5,234,124 | A * | 8/1993 | Buckner, III | A61B 1/121 | 220/326 |
| 5,346,267 | A * | 9/1994 | Betteridge | B60J 7/1642 | 292/263 |
| 5,577,779 | A * | 11/1996 | Dangel | E05C 19/06 | 220/326 |
| 6,779,681 | B2 * | 8/2004 | Doerfler | E05C 19/06 | 220/326 |
| 10,871,014 | B2 * | 12/2020 | Cho | B60R 7/06 | |

* cited by examiner

ENCLOSURE STRUCTURE AND ENCLOSURE ASSEMBLY COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 202022382824.3 filed Oct. 23, 2020, and to Chinese Patent Application No. 202110356358.8 filed Apr. 1, 2021. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to the field of enclosures, and more particularly to an enclosure structure and an enclosure assembly comprising the same.

Enclosure structures refer to walls, doors, windows, etc. given to any part of a building that physically separates the external from the interior environment. For enclosure structures such as doors and windows, usually one end is rotatable and the other end is fixed by a locking structure. The existing locking structure is complex, and is usually additionally mounted on doors and windows. The mounting process is laborious and the produced enclosure structures are costly.

SUMMARY

In one aspect, the disclosure provides an enclosure structure comprising an enclosure body, a handle, and a slot. The enclosure body comprises a first end portion and a second end portion that are disposed oppositely to each other. The enclosure body is provided with a clearance hole, and the clearance hole is disposed between the first end portion and the second end portion, and the handle is rotatably disposed on the enclosure body and is disposed between the clearance hole and the first end portion.

The handle comprises an elastic connecting portion, a boss, and a pressing portion. The pressing portion is configured to control a limiting member to be stuck in or detached from the slot; the elastic connecting portion protrudes out of the enclosure body and two ends thereof are connected to the enclosure body and the boss, respectively; the boss and the enclosure body are spaced apart and the boss extends from the elastic connecting portion in a direction approaching the first end portion; and the boss, the elastic connecting portion, and the enclosure body cooperate to form the slot.

In a class of this embodiment, the pressing portion is fixedly disposed on one end of the elastic connecting portion where the boss is disposed, and the pressing portion and the enclosure body are spaced apart and the pressing portion extends from the elastic connecting portion in a direction away from the boss.

In a class of this embodiment, one side of the boss departing from the slot is defined as a circular arc surface.

In a class of this embodiment, the elastic connecting portion, the boss and the pressing portion are integrally formed.

In a class of this embodiment, the enclosure body comprises an enclosure plate; the enclosure plate comprises a first side portion and a second side portion that are disposed oppositely to each other, and the clearance hole passes through the enclosure plate from the first side portion to the second side portion. The elastic connecting portion is protrudingly disposed on the first side portion, and the boss, the elastic connecting portion and the enclosure plate cooperate to form the slot.

In a class of this embodiment, the enclosure body comprises an enclosure plate and an enclosure fence, and the enclosure plate comprises a first side portion and a second side portion that are disposed oppositely to each other. The enclosure fence is protrudingly disposed on the first side portion along the circumference of the enclosure plate; the clearance hole passes though the enclosure plate from the first side portion to the second side portion. The elastic connecting portion is protrudingly disposed on the enclosure fence, and the boss and the pressing portion are both spaced apart from the enclosure plate.

In a class of this embodiment, the enclosure fence comprises a coaming disposed between the clearance hole and the first end portion; the coaming comprises a coaming body and an elastic portion, and the distance between the elastic portion and the first end portion is greater than the distance between the coaming body and the first end portion, the elastic connecting portion is fixedly disposed on the end of the elastic portion away from the enclosure plate, and the boss, the elastic connecting portion and the coaming body cooperate to form the slot.

In a class of this embodiment, the handle and the elastic portion are integrally formed.

In a class of this embodiment, the material of the elastic connecting portion is plastic; and/or, the material of the elastic portion is plastic.

In another aspect, the disclosure provides an enclosure assembly comprising a fixing structure and the aforementioned enclosure structure; the fixing structure comprises a limiting member, and the first end portion of the enclosure structure is stuck in the slot via the limiting member and is connected to the fixing structure, and the second end portion of the enclosure structure is rotatably connected to the fixing structure.

The disclosure provides an enclosure structure and an enclosure assembly. Taking the enclosure structure provided herein for a door as an example, the beneficial effects of the disclosure are described as follows. For the enclosure structure provided in the disclosure, the boss, the elastic connecting portion and the enclosure body cooperate to form slot, when the limiting member is stuck in the slot, door closing is achieved, when the limiting member is detached from the slot, the door opening is achieved; a handle that comprises a pressing portion and an elastic connecting portion is disposed, when a force is applied to the pressing portion, the notch of the slot is enlarged by the elastic action of the elastic connecting portion, such that the limiting member that is stuck in the slot is detached from the slot or the limiting member can be stuck in the slot; a clearance hole is disposed, such that a hand is convenient to reach the inside from outside the door and apply force to the pressing portion. In addition, the handle is directly disposed on the enclosure body, and users need not install it separately. The enclosure structure provided in the disclosure can also be used for doors, windows, drawers, storage boxes, shoe boxes, etc. Therefore, the enclosure structure provided in the disclosure is easy to operate and is low in cost.

Figure 1:
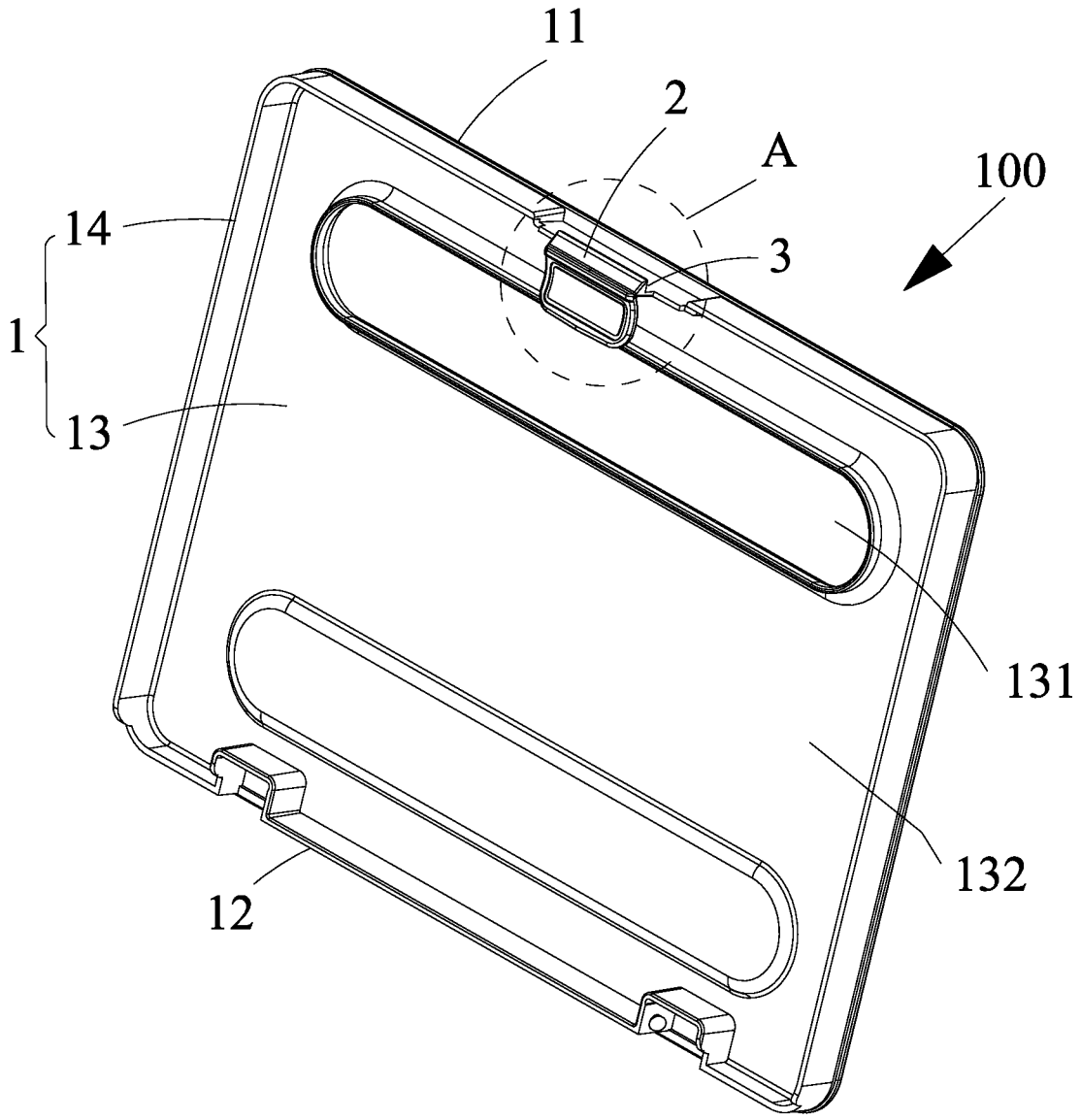
FIG. 1 is a schematic view of an enclosure structure from a perspective provided in an embodiment of the disclosure.

In the drawings, the following reference numbers are used: 100. Enclosure structure; 1. Enclosure body; 11. First end portion; 12. Second end portion; 13. Enclosure plate; 131. Clearance hole; 132. First side portion; 133. Second side portion; 14. Enclosure fence; 141. Coaming; 1411. Coaming body; 1412. Elastic portion; 2. Handle; 21. Elastic connecting portion; 22. Boss; 221. Circular arc surface; 23. Pressing portion; 3. Slot; 200. Limiting member.

DETAILED DESCRIPTION

To further illustrate, embodiments detailing an enclosure structure and an enclosure assembly comprising the same are described below. It should be noted that the following embodiments are intended to describe and not to limit the disclosure.

Referring to FIGS. 1 to 4, an enclosure structure 100 provided in the embodiments of the disclosure comprises an enclosure body 1, a handle 2, and a slot 3. The enclosure body 1 comprises a first end portion 11 and a second end portion 12 that are disposed oppositely. The enclosure body 1 is provided with a clearance hole 131, and the clearance hole 131 is disposed between the first end portion 11 and the second end portion 12, and the handle 2 is rotatably disposed on the enclosure body 1 and is disposed between the clearance hole 131 and the first end portion 11. The handle 2 comprises an elastic connecting portion 21, a boss 22 and a pressing portion 23. The pressing portion 23 is configured to control a limiting member 200 to be stuck in or detached from the slot 3; the elastic connecting portion 21 protrudes out of the enclosure body 1 and two ends thereof are connected to the enclosure body 1 and the boss 22, respectively; the boss 22 and the enclosure body 1 are spaced apart and the boss extends from the elastic connecting portion 21 in a direction gradually approaching the first end portion 11; and the boss 22, the elastic connecting portion 21 and the enclosure body 1 cooperate to form the slot 3.

The enclosure structure 100 provided in the disclosure can be used for a variety of products that require enclosure storage such as doors, windows, drawers, storage boxes, shoe boxes, etc. Taking the enclosure structure 100 for a door as an example, for the enclosure structure 100 provided in the embodiments of the disclosure, the boss 22, the elastic connecting portion 21 and the enclosure body 1 cooperate to form slot 3, when the limiting member 200 is stuck in the slot 3, door closing is achieved, when the limiting member 200 is detached from the slot 3, the door opening is achieved; a handle 2 that comprises a pressing portion 23 and an elastic connecting portion 21 is disposed, when a force is applied to the pressing portion 23, the notch of the slot 3 is enlarged by the elastic action of the elastic connecting portion 21, such that the limiting member 200 that is stuck in the slot 3 is detached from the slot 3 or the limiting member 200 can be stuck in the slot 3, making door opening and closing easy; a clearance hole 131 is disposed, such that a hand is convenient to reach the inside from outside the door and apply force to the pressing portion 23. In addition, the handle 2 is directly disposed on the enclosure body 1, and users need not install it separately. Therefore, the enclosure structure 100 provided in the disclosure is easy to operate and is low in cost.

Figure 2:
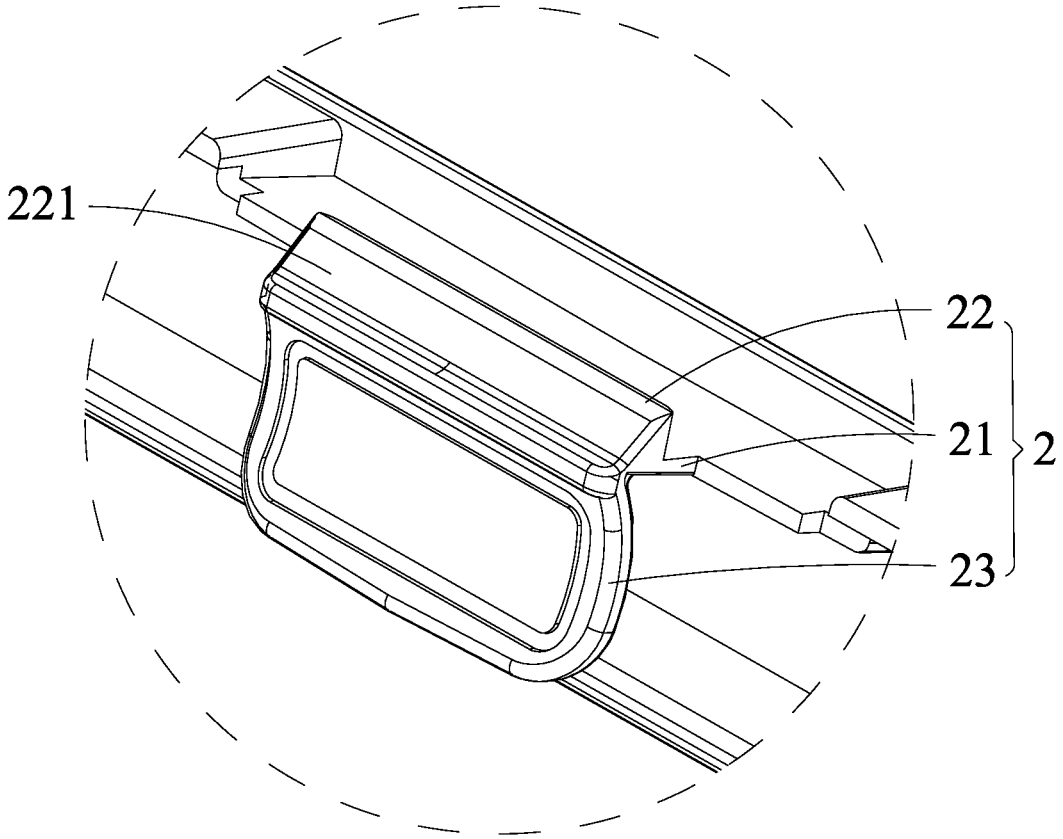
FIG. 2 is a partial enlarged view of part A in FIG. 1.
Figure 3:
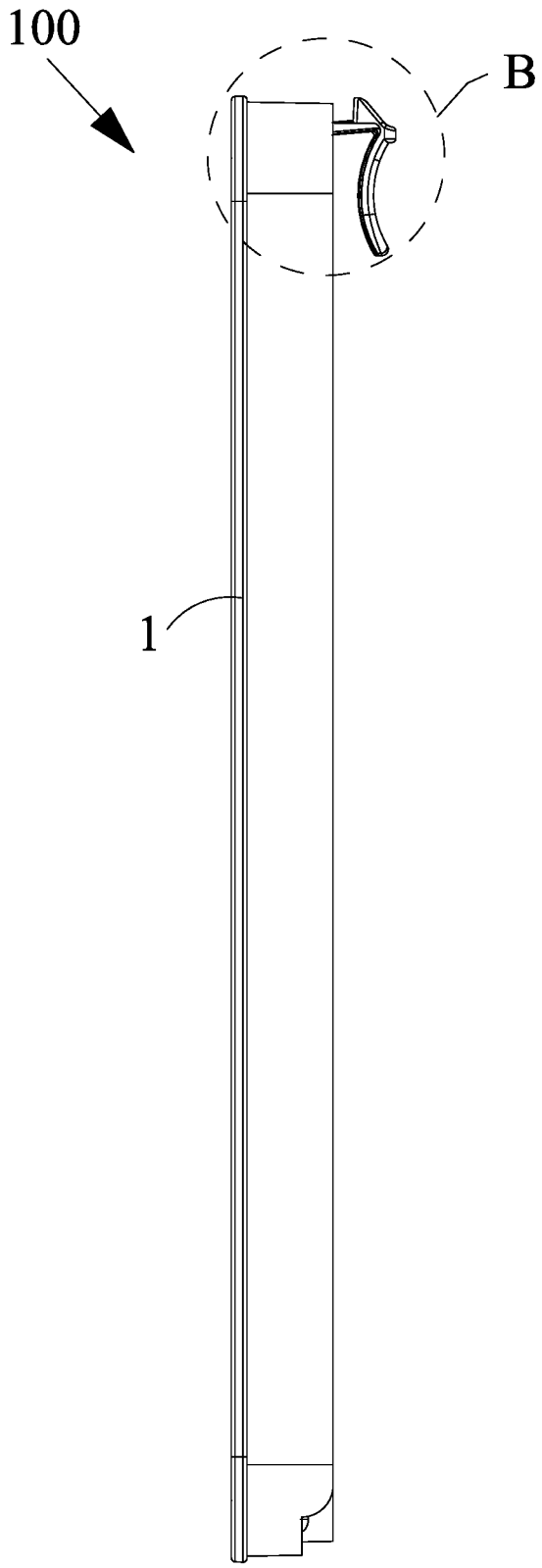
FIG. 3 is a schematic view of an enclosure structure from another perspective provided in an embodiment of the disclosure.
Figure 4:
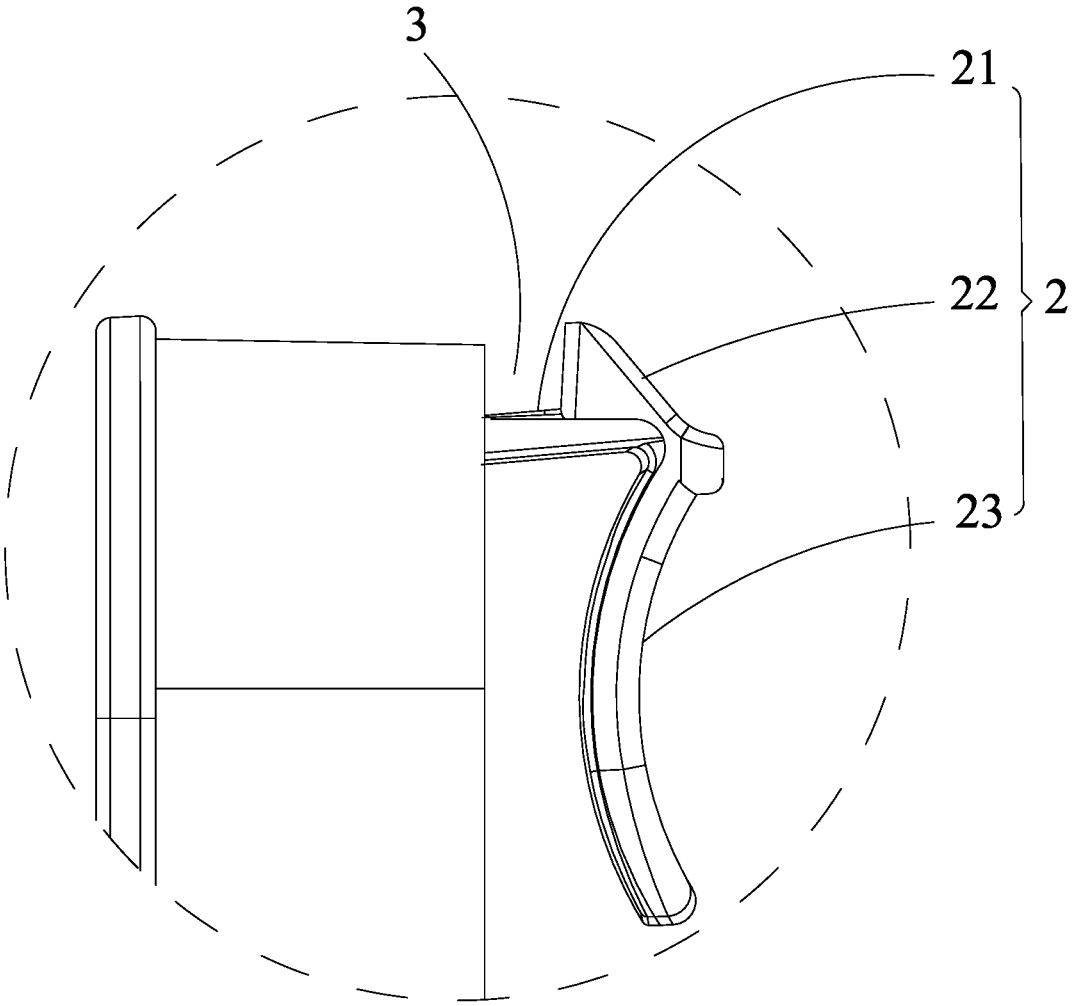
FIG. 4 is a partial enlarged view of part B in FIG. 3.

Referring to FIG. 1 and FIG. 2, the pressing portion 23 is fixedly disposed on one end of the elastic connecting portion 21 where the boss 22 is disposed, the pressing portion 23 and the enclosure body 1 are spaced apart and the pressing portion extends from the elastic connecting portion 21 in a direction away from the boss 22. The pressing portion 23 extends in the direction away from the boss 22, that is, the pressing portion 23 extends in the direction where the clearance hole 131 is disposed, such that a hand can apply force to the pressing portion 23 after reaching the clearance hole 131; the pressing portion 23 and the enclosure body 1 are spaced apart to ensure that there is room to move when the pressing portion 23 is pressed. The pressing portion 23 can be provided in any shape such as a rod shape or a sheet shape, etc.

In certain embodiments, the side of the boss 22 departing from the slot 3 is set as a circular arc surface 221. In the process of closing the door, the side of the boss 22 having the circular arc surface 221 abuts on the limiting member 200 first. The setting of the circular arc surface 221 can reduce the wear of the boss 22.

In certain embodiments, the elastic connecting portion 21, the boss 22 and the pressing portion 23 are integrally formed. This arrangement is convenient for processing and production. Of course, in other embodiments, the elastic connecting portion 21, the boss 22 and the pressing portion 23 may also be assembled together separately.

Figure 5:
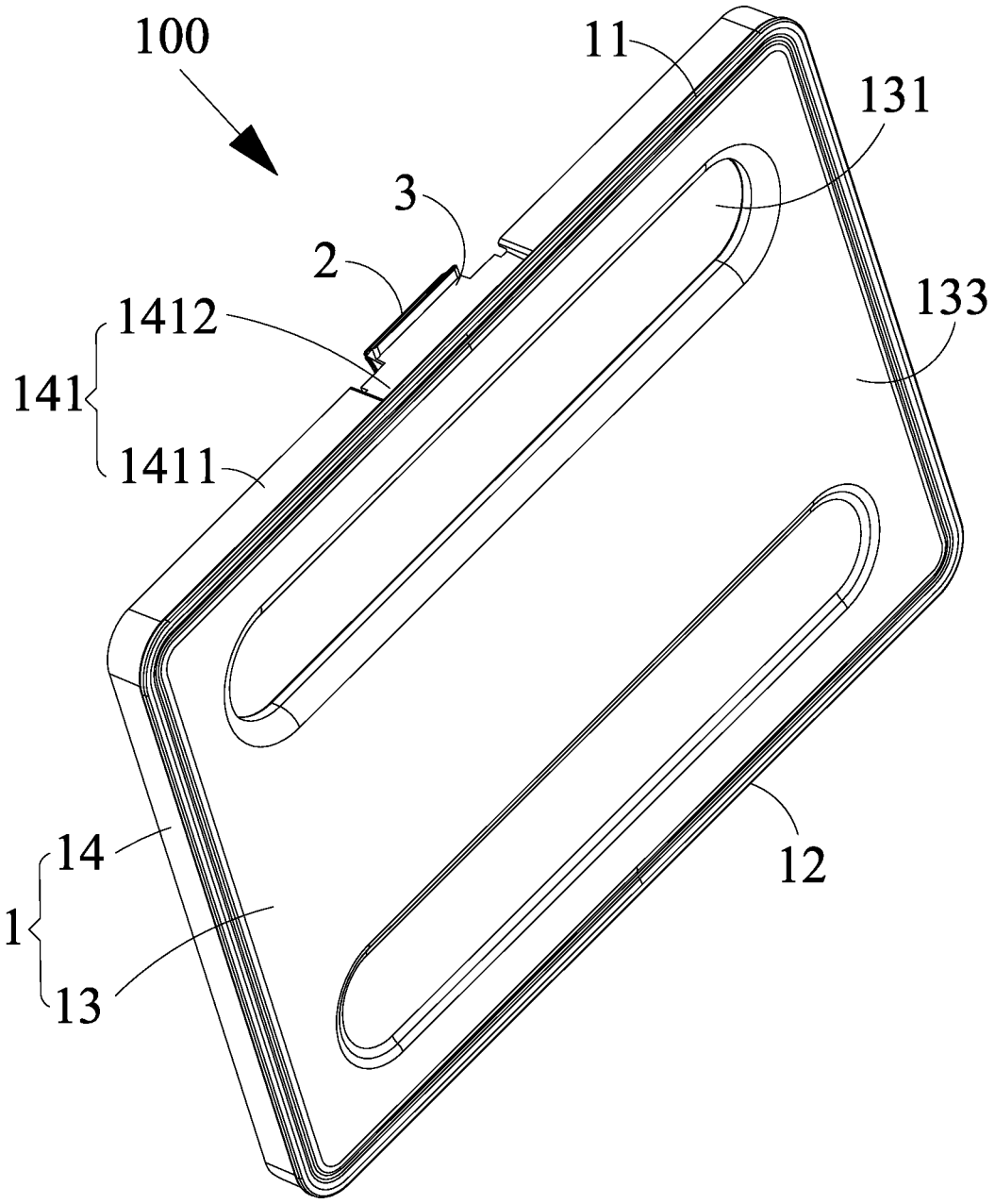
FIG. 5 is a schematic view of an enclosure structure from another perspective provided in an embodiment of the disclosure.

Referring to FIG. 1 and FIG. 5, an enclosure body 1 comprises an enclosure plate 13 and an enclosure fence 14, the enclosure plate 13 comprises a first side portion 132 and a second side portion 133 that are disposed oppositely to each other. The enclosure fence 14 is protrudingly disposed on the first side portion 132 along the circumference of the enclosure plate 13; the clearance hole 131 passes though the enclosure plate 13 from the first side portion 132 to the second side portion 133. The elastic connecting portion 21 is protrudingly disposed on the enclosure fence 14, and the boss 22 and the pressing portion 23 are both spaced apart from the enclosure plate 13. The enclosure fence 14 is configured to seal the enclosure space to prevent debris from entering the inside of the enclosure plate 13, i.e. the first side portion 132 of the enclosure plate 13 provided in this embodiment. For example, the enclosure fence 14 can block ants, cockroaches, etc. from the outside of the enclosure plate 13, i.e. the second side portion 133 of enclosure plate 13. As an alternative embodiment, the elastic connecting portion 21 is protrudingly disposed on the first side portion 132, the boss 22, the elastic connecting portion 21 and the enclosure plate 13 cooperate to form the slot 3, that is, it is permissible that the enclosure body 1 is not provided with the enclosure fence 14.

Referring to FIG. 5, the enclosure fence 14 comprises a coaming 141 disposed between the clearance hole 131 and the first end portion 11; the coaming 141 comprises a coaming body 1411 and an elastic portion 1412, and the distance between the elastic portion 1412 and the first end portion 11 is greater than the distance between the coaming body 1411 and the first end portion 11; the elastic connecting portion 21 is fixedly disposed on the end of the elastic portion 1412 away from the enclosure plate 13, and the boss 22, the elastic connecting portion 21 and the coaming body 1411 cooperate to form the slot. In this way, the boss 22 and the enclosure plate 13 are connected by the elastic connecting portion 21 and the elastic portion 1412, increasing the distance between the boss 22 and the enclosure plate 13. Because the elastic portion 1412 is also elastic, it indirectly increases the distance of the elastic connecting portion 21 between the boss 22 and the enclosure plate 13, to facilitate the limiting member 200 to be stuck in the slot 3 or detached from the slot 3. In this embodiment, the elastic portion 1412 is disposed in the middle of the coaming body 1411 to separate the coaming body 1411 into two parts. This arrangement increases the stability of the limiting member 200 stuck in the slot 3. In this embodiment, the distance between the coaming body 1411 and the first end portion 11 is greater than zero. In other embodiments, the distance between the coaming body 1411 and the first end portion 11 may be zero, that is, the coaming body 1411 is directly disposed on the first end portion 11.

In certain embodiments, the handle 2 and the elastic portion 1412 are integrally formed. This arrangement is convenient for processing and production. Of course, in other embodiments, the handle 2 and the elastic portion 1412 may be assembled together.

In certain embodiments, the material of the elastic connecting portion 21 and the elastic portion 1412 is plastic; the elastic connecting portion 21 and the elastic portion 1412 are made of plastic material, such that the elastic connecting portion 21 and the elastic portion 1412 have a certain hardness to firmly connect the boss 22 and the enclosure plate 13, and have a certain elasticity, to enable the limiting member 200 to be detached from and stuck in the slot 3. In this embodiment, all components of the enclosure structure 100 are made of plastic materials, and the entire enclosure structure 100 is integrally formed, which is beneficial to reduce manufacturing costs. Of course, in other embodiments, the enclosure plate 13 may also be made of wood.

Figure 6:
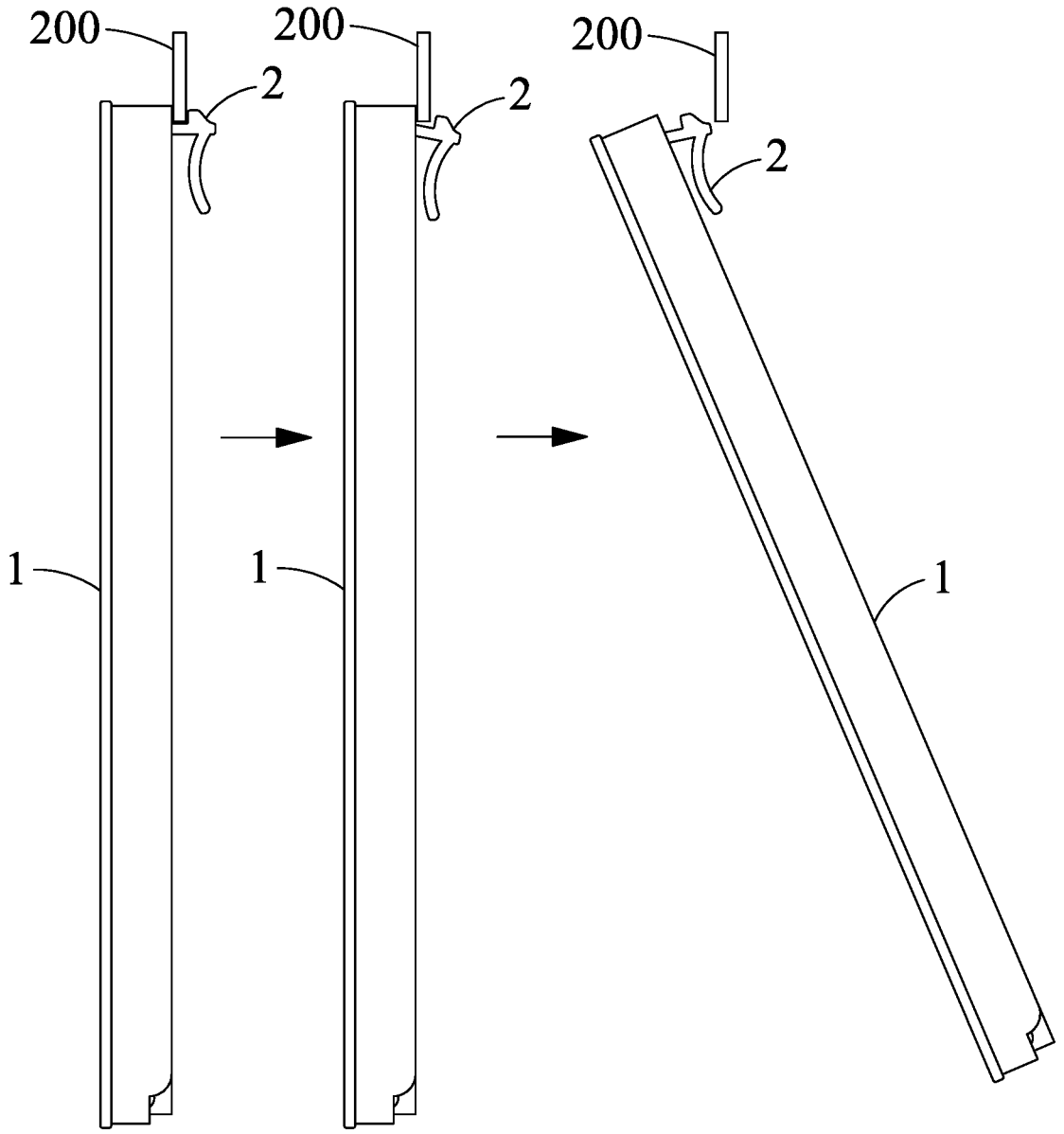
FIG. 6 is a flow diagram showing the opening process of an enclosure structure provided in an embodiment of the disclosure.

Referring to FIG. 6, when it is required to open the door, a hand is stretched out to pass through the clearance hole 131 to apply force to the pressing portion 23, the elastic connecting portion 21 is elastically deformed by the force, the notch of the slot 3 becomes larger, the boss 22 is detached from the limiting member 200, and the enclosure plate 13 is controlled to rotate around the second end portion 12, such that the limiting member 200 is detached from the slot 3 to achieve door opening.

Figure 7:
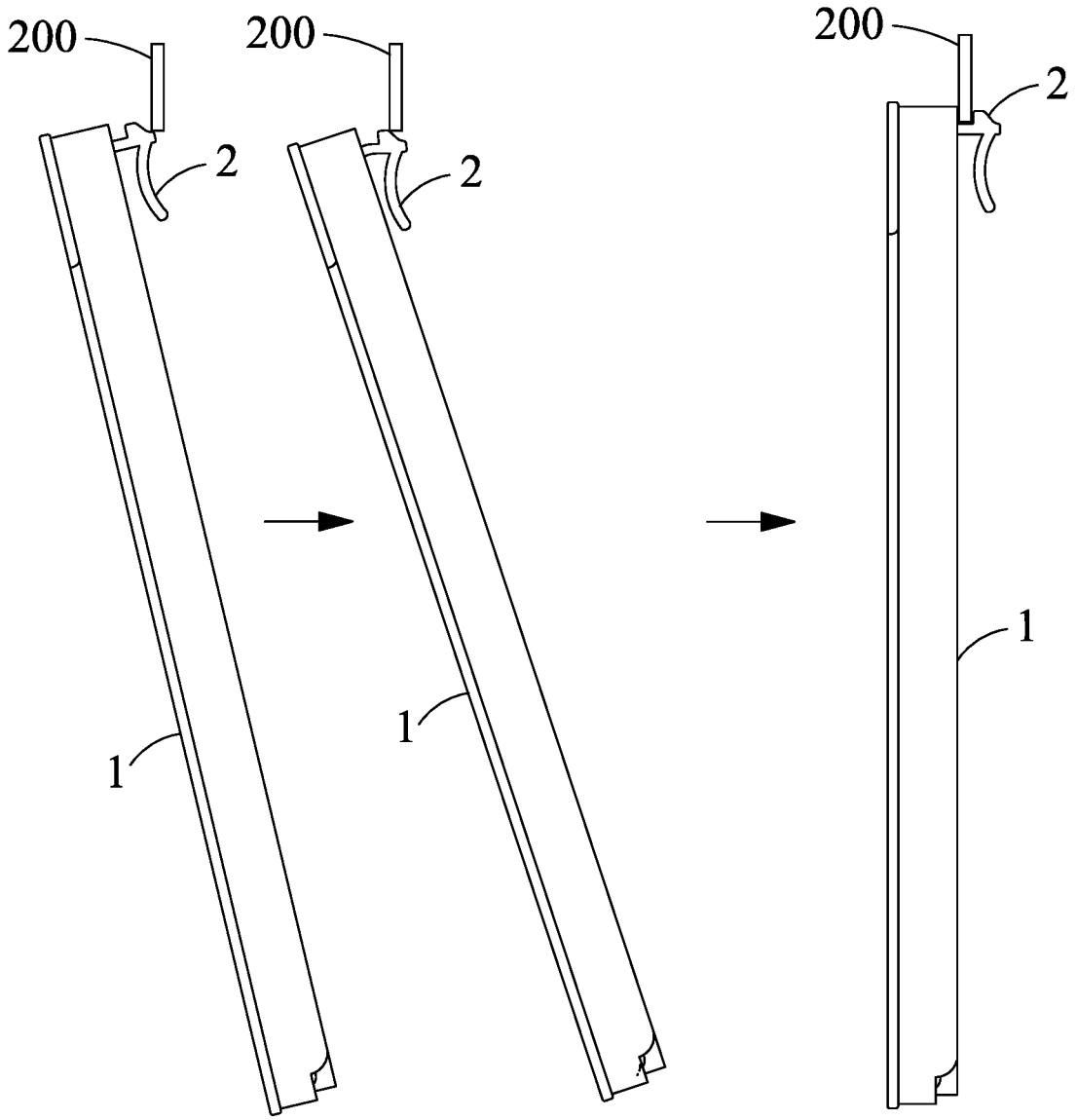
FIG. 7 is a flow diagram showing the closing process of an enclosure structure provided in an embodiment of the disclosure.

Referring to FIG. 7, when it is required to close the door, the enclosure plate 13 is directly pushed to approach the limiting member 200, the limiting member 200 presses against the boss 22, the elastic connecting portion 21 is elastically deformed by force. When the limiting member 200 is completely accommodated in the slot 3, the elastic connecting portion 21 recovers to its original state. The relative position of the enclosure plate 13 and the limiting member 200 is fixed, that is, the door is in a closed state at this time. In addition, the door can also be closed in the following way: a hand is stretched out to pass through the clearance hole 131 to apply force to the pressing portion 23, the elastic connecting portion 21 is elastically deformed by the force, the notch of the slot 3 becomes larger, and the enclosure plate 13 is controlled to rotate around the second end portion 12 to make the limiting member 200 to be located in the slot 3, then stop applying force to the pressing portion 23 to restore the notch of the slot 3 to the original shape, and the limiting member 200 is stuck in the slot 3 to achieve door closing.

The embodiment of the disclosure further provides an enclosure assembly (not shown), comprising a fixing structure (not shown) and the aforementioned enclosure structure 100, and the fixing structure comprises a limiting member 200. The first end portion 11 of the enclosure structure 100 is stuck in slot 3 via the limiting member 200, and is connected to the fixing structure, and the second end portion 12 of the enclosure structure 100 is rotatably connected to the fixing structure. The enclosure assembly provided in the embodiments of the disclosure can be used for a variety of products that require enclosure storage such as doors, windows, drawers, storage boxes, shoe boxes, etc.

It will be obvious to those skilled in the art that changes and modifications may be made, and therefore, the aim in the appended claims is to cover all such changes and modifications.

What is claimed is:

1. A device, comprising:

an enclosure body, the enclosure body comprising a first end portion and a second end portion that are disposed oppositely to each other, and a clearance hole disposed between the first end portion and the second end portion;

a handle, the handle comprising an elastic connecting portion, a boss, and a pressing portion; and a slot;

wherein:

the handle is rotatably disposed on the enclosure body and is disposed between the clearance hole and the first end portion;

the pressing portion is configured to control a limiting member to be stuck in or detached from the slot;

the elastic connecting portion protrudes out of the enclosure body and two ends thereof are connected to the enclosure body and the boss;

the boss and the enclosure body are spaced apart and the boss extends from the elastic connecting portion in a direction approaching the first end portion; and the boss, the elastic connecting portion, and the enclosure body cooperate to form the slot.

2. The device of claim 1, wherein the pressing portion is fixedly disposed on one end of the elastic connecting portion where the boss is disposed, and the pressing portion and the enclosure body are spaced apart and the pressing portion extends from the elastic connecting portion in a direction away from the boss.

3. The device of claim 2, wherein the elastic connecting portion, the boss and the pressing portion are integrally formed.

4. The device of claim 2, wherein the enclosure body comprises an enclosure plate; the enclosure plate comprises a first side portion and a second side portion that are disposed oppositely to each other, and the clearance hole passes through the enclosure plate from the first side portion to the second side portion; the elastic connecting portion is protrudingly disposed on the first side portion, and the boss, the elastic connecting portion and the enclosure plate cooperate to form the slot.

5. The device of claim 2, wherein the enclosure body comprises an enclosure plate and an enclosure fence, and the enclosure plate comprises a first side portion and a second side portion that are disposed oppositely to each other; the enclosure fence is protrudingly disposed on the first side portion along a circumference of the enclosure plate; the clearance hole passes though the enclosure plate from the first side portion to the second side portion; the elastic connecting portion is protrudingly disposed on the enclosure fence, and the boss and the pressing portion are both spaced apart from the enclosure plate.

6. The device of claim 5, wherein the enclosure fence comprises a coaming disposed between the clearance hole and the first end portion; the coaming comprises a coaming body and an elastic portion, and a distance between the elastic portion and the first end portion is greater than a distance between the coaming body and the first end portion; the elastic connecting portion is fixedly disposed on one end of the elastic portion away from the enclosure plate, and the boss, the elastic connecting portion and the coaming body cooperate to form the slot.

7. The device of claim 6, wherein the handle and the elastic portion are integrally formed.

8. The device of claim 1, wherein one side of the boss departing from the slot is defined as a circular arc surface.

9. The device of claim 8, wherein the elastic connecting portion, the boss and the pressing portion are integrally formed.

10. The device of claim 8, wherein the enclosure body comprises an enclosure plate; the enclosure plate comprises a first side portion and a second side portion that are disposed oppositely to each other, and the clearance hole passes through the enclosure plate from the first side portion to the second side portion; the elastic connecting portion is protrudingly disposed on the first side portion, and the boss, the elastic connecting portion and the enclosure plate cooperate to form the slot.

11. The device of claim 8, wherein the enclosure body comprises an enclosure plate and an enclosure fence, and the enclosure plate comprises a first side portion and a second side portion that are disposed oppositely to each other; the enclosure fence is protrudingly disposed on the first side portion along a circumference of the enclosure plate; the clearance hole passes though the enclosure plate from the first side portion to the second side portion; the elastic connecting portion is protrudingly disposed on the enclosure fence, and the boss and the pressing portion are both spaced apart from the enclosure plate.

12. The device of claim 11, wherein the enclosure fence comprises a coaming disposed between the clearance hole and the first end portion; the coaming comprises a coaming body and an elastic portion, and a distance between the elastic portion and the first end portion is greater than a distance between the coaming body and the first end portion; the elastic connecting portion is fixedly disposed on one end of the elastic portion away from the enclosure plate, and the boss, the elastic connecting portion and the coaming body cooperate to form the slot.

13. The device of claim 12, wherein the handle and the elastic portion are integrally formed.

14. The device of claim 1, wherein the elastic connecting portion, the boss and the pressing portion are integrally formed.

15. The device of claim 1, wherein the enclosure body comprises an enclosure plate; the enclosure plate comprises a first side portion and a second side portion that are disposed oppositely to each other, and the clearance hole passes through the enclosure plate from the first side portion to the second side portion; the elastic connecting portion is protrudingly disposed on the first side portion, and the boss, the elastic connecting portion and the enclosure plate cooperate to form the slot.

16. The device of claim 1, wherein the enclosure body comprises an enclosure plate and an enclosure fence, and the enclosure plate comprises a first side portion and a second side portion that are disposed oppositely to each other; the enclosure fence is protrudingly disposed on the first side portion along a circumference of the enclosure plate; the clearance hole passes though the enclosure plate from the first side portion to the second side portion; the elastic connecting portion is protrudingly disposed on the enclosure fence, and the boss and the pressing portion are both spaced apart from the enclosure plate.

17. The device of claim 16, wherein the enclosure fence comprises a coaming disposed between the clearance hole and the first end portion; the coaming comprises a coaming body and an elastic portion, and a distance between the elastic portion and the first end portion is greater than a distance between the coaming body and the first end portion; the elastic connecting portion is fixedly disposed on one end of the elastic portion away from the enclosure plate, and the boss, the elastic connecting portion and the coaming body cooperate to form the slot.

18. The device of claim 17, wherein the handle and the elastic portion are integrally formed.

19. The device of claim 17, wherein a material of the elastic connecting portion is plastic; and/or, a material of the elastic portion is plastic.

20. An enclosure assembly comprising a fixing structure and the device of claim 1; wherein the fixing structure comprises the limiting member, and the first end portion of the enclosure structure is stuck in the slot via the limiting member and is connected to the fixing structure, and the second end portion of the enclosure structure is rotatably connected to the fixing structure.

* * * * *